US006994216B2

(12) United States Patent
Wong

(10) Patent No.: US 6,994,216 B2
(45) Date of Patent: Feb. 7, 2006

(54) STORAGE CONTAINER

(75) Inventor: Michael P. Wong, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 35 days.

(21) Appl. No.: 10/410,565

(22) Filed: Apr. 7, 2003

(65) Prior Publication Data

US 2004/0195139 A1 Oct. 7, 2004

(51) Int. Cl.
*B65D 21/06* (2006.01)

(52) U.S. Cl. ..... 206/506

(58) Field of Classification Search ..... 206/506, 206/509

See application file for complete search history.

(56) References Cited

U.S. PATENT DOCUMENTS

| | | | | |
|---|---|---|---|---|
| 1,689,217 | A | 10/1928 | White | |
| 2,134,875 | A | 11/1938 | Henze | |
| 3,220,603 | A | 11/1965 | Bromley | |
| 3,895,715 | A | 7/1975 | Drader | |
| 3,904,066 | A | 9/1975 | Wilson | |
| 3,951,265 | A | 4/1976 | Carroll | |
| 4,106,623 | A | 8/1978 | Carroll | |
| 4,109,791 | A | 8/1978 | Clipson et al. | |
| 4,241,831 | A | 12/1980 | Locatelli | |
| 4,391,369 | A | 7/1983 | Stahl et al. | |
| 4,423,813 | A | 1/1984 | Kreeger et al. | |
| 4,573,577 | A | 3/1986 | Miller | |
| RE32,223 | E | 8/1986 | Kreeger et al. | |
| 4,901,859 | A * | 2/1990 | Jones | 206/506 |
| 4,905,833 | A | 3/1990 | Kreeger et al. | |
| 4,947,992 | A | 8/1990 | Schafer | |
| 4,982,844 | A | 1/1991 | Madan et al. | |
| 5,060,799 | A | 10/1991 | De Pagter | |
| 5,083,666 | A | 1/1992 | Lam | |
| 5,353,948 | A | 10/1994 | Lanoue et al. | |
| 5,415,293 | A | 5/1995 | Ackermann | |
| 5,494,163 | A | 2/1996 | Apps | |
| D381,203 | S | 7/1997 | Ackermann | |
| 5,752,602 | A | 5/1998 | Ackermann et al. | |
| 5,881,902 | A | 3/1999 | Ackermann | |
| D429,565 | S | 8/2000 | Aiken | |
| 6,138,863 | A | 10/2000 | Aiken | |
| D436,729 | S | 1/2001 | Aiken | |
| 6,179,156 | B1 | 1/2001 | Aiken | |
| 6,581,330 | B1 | 6/2003 | Helsloot et al. | |
| 2003/0222081 | A1 * | 12/2003 | Apps et al. | 220/7 |

FOREIGN PATENT DOCUMENTS

| | | | |
|---|---|---|---|
| DE | 35 11 321 | | 10/1986 |
| DE | 35 21 894 | | 1/1987 |
| DE | 91 10 097 | U | 10/1991 |
| DE | 199 39 019 | A1 | 2/2001 |
| DE | 200 02 537 | U1 | 7/2001 |
| EP | 0 299 657 | A | 1/1989 |
| EP | 0 341 074 | A | 1/1989 |
| EP | 0 311 174 | A1 | 4/1989 |
| FR | 2325565 | * | 4/1977 |

(Continued)

*Primary Examiner*—Joseph C. Merek

(57) ABSTRACT

A storage container includes a corner support extending across each corner and supported on an upper edge of each of the two adjacent walls in the corner. Each corner support is hingeably connected to one of the two adjacent walls. The corner support is supported on an upper surface of a column projecting inward from each adjacent wall. A ledge also protrudes inward from each column and supports a leg extending downward from the corner support. A third ledge is formed on an inner surface of the corner and supports a third leg extending downward from the corner support. Each corner support is pivotable about its hinge between a use position, generally parallel to the base, and an open position, generally adjacent one of the edge walls.

36 Claims, 9 Drawing Sheets

FOREIGN PATENT DOCUMENTS

| | | |
|---|---|---|
| GB | 657 502 A | 9/1951 |
| GB | 2 129 401 | 5/1984 |
| GB | 2 141 778 | 1/1985 |
| GB | 2 171 980 | 9/1986 |
| NL | 790 5105 | 6/1979 |
| WO | WO 00/27716 | 5/2000 |
| WO | WO 00/66440 | 11/2000 |
| WO | WO 03/101846 A1 | 12/2003 |

* cited by examiner

STORAGE CONTAINER

BACKGROUND OF THE INVENTION

This invention relates to a multi-purpose container for storing and transporting items such as produce.

Plastic containers are often used for transporting produce, such as grapes, from the fields where they are grown to the markets where they are purchased. The containers must be both stackable, such that the walls of each container supports the weight of additional containers stacked on top of it, and nestable, such that the containers fit substantially one within the other to minimize the space occupied when not in use.

One such container, disclosed in U.S. Pat. No. 6,179,156 and commonly assigned, includes a pair of partial lids. Each partial lid is connected by a hinge to an upper edge of an end wall and movable between a support position and an open position. In the support position, the partial lid rests along the entire length of the upper edge of the end wall and is supported on a portion of the upper edge of both side walls. In order to reduce the space required adjacent the containers when in the nested, storage position, the lids extend only approximately ¼ of the length of the side walls, and thus when pivoted to the open position can hang downward close to the end wall of the container. While this container works well, Applicant has sought to further increase the load bearing capacity of the containers when stacked, further reduce the weight of the container and to further increase the stacking stability of the containers.

SUMMARY OF THE INVENTION AND ADVANTAGES

The present invention provides a storage container with increased strength and load bearing capacity for supporting like containers stacked thereon and which occupies even less space when nested with other crates for storage.

Generally, the container of the present invention provides corner supports in a preferred embodiment, the corner supports connected by hinges to the upper edges of the walls of the container and supported on the upper edges of the two adjacent walls forming the corner. These corner supports are significantly smaller than the partial lids in the previous design, thus reducing the weight of the container while increasing the capacity of the loaded, stacked containers.

In order to provide sufficient strength and load bearing characteristics, the corner supports include two legs extending downward onto ledges formed on an inner surface of each of the two adjacent walls in the corner. Additionally, the corner support is provided with a third leg extending downward onto a ledge formed on an inner surface of the corner. The legs provide a mechanism by which the load may be transferred from the corner supports to the walls of the container. Thus, although significantly smaller than the partial lids of the previous design, the corner supports of the present invention are sufficiently strong to support loaded additional crates.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
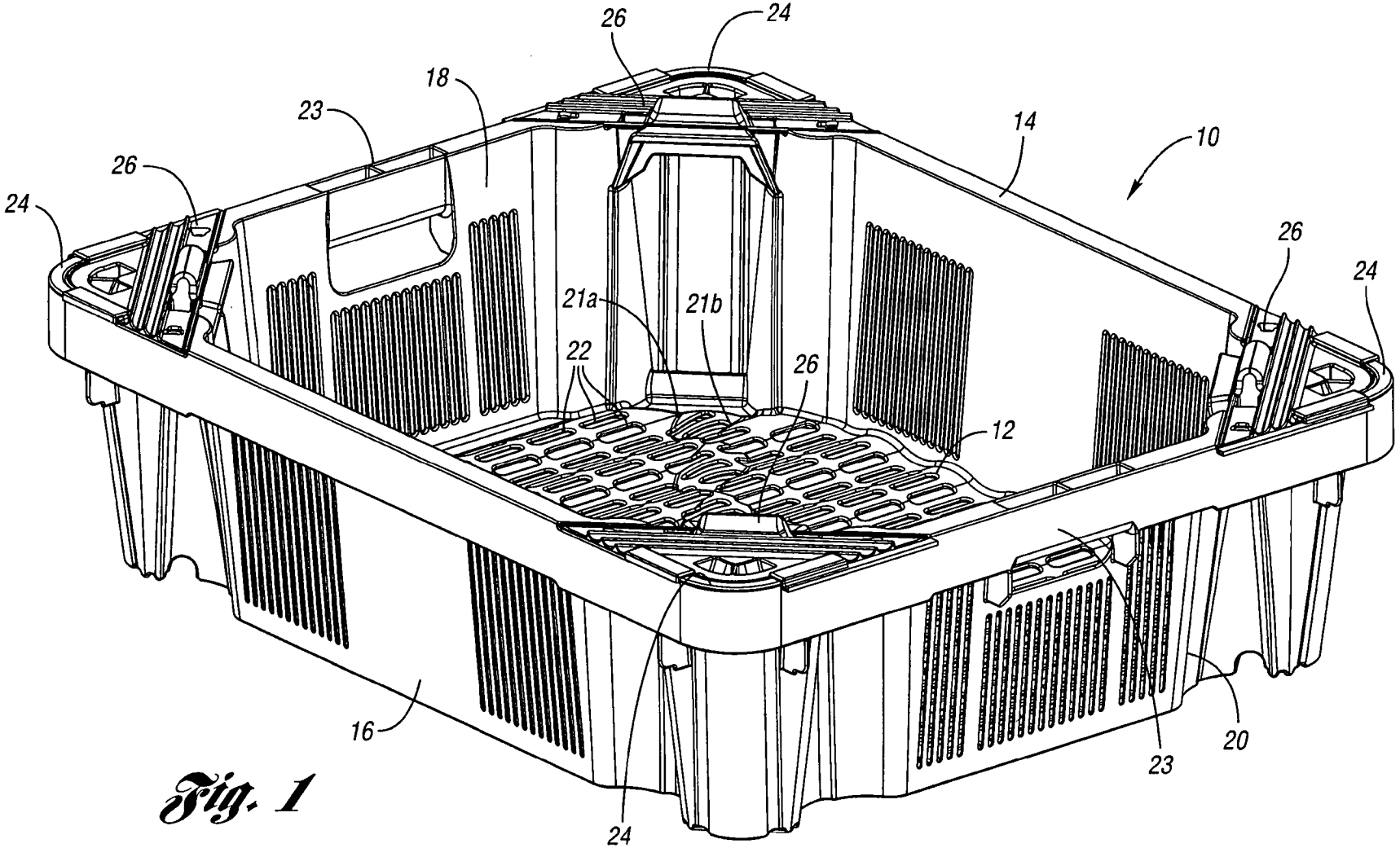
FIG. 1 is a perspective view of a first preferred embodiment of a container according to the present invention

A storage container 10 of FIG. 1 generally comprises a base 12 from which side walls 14 and 16 extend upward, as do end walls 18 and 20. For improved support, drainage and aeration, the base 12 has a generally sinusoidal upper surface with two superimposed, diagonally extending, out-of-phase, roughly sinusoidal channel depressions 21*a* and 21*b*. Base 12 further includes a plurality of apertures 22, as shown. A handle 23 is formed near the upper edge of each end wall 18, 20. Each adjacent pair of walls 14, 16, 18, 20 meet in a rounded corner 24. In a preferred embodiment, shown in FIGS. 1–9, a corner support 26 extends across the upper edges of the adjacent pair of walls in each corner 24.

Figure 2:
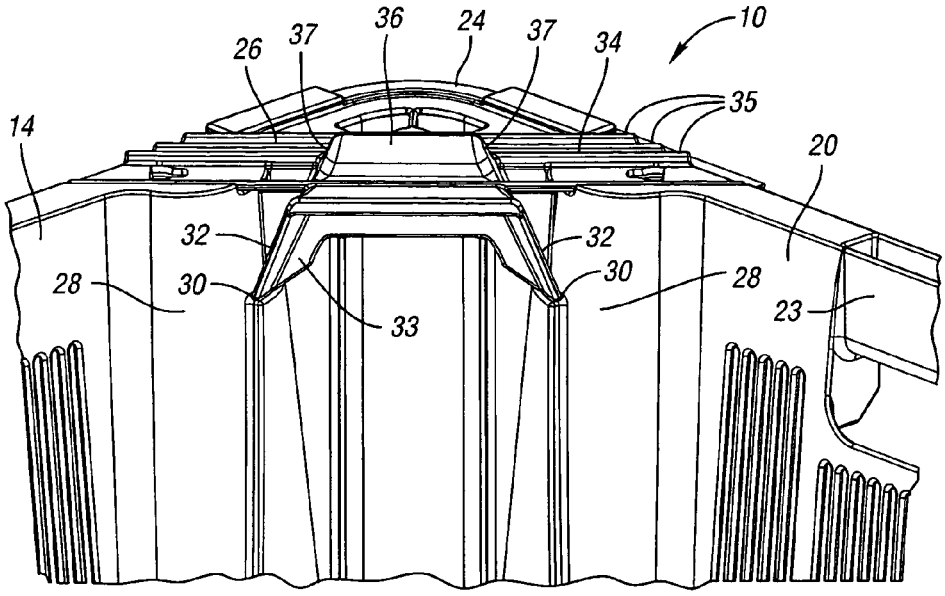
FIG. 2 is an enlarged, perspective view of an interior corner of the container of FIG. 1, showing the corner support in the support position.

FIG. 2 is an interior view of one of the corners 24 where side wall 14 and end wall 20 meet. Generally, all four of the corner supports 26 and the container 10 are similar to the corner support 26 shown in FIG. 2. As can be seen in FIG. 2, the side wall 14 and end wall 20 each include a column 28 projecting inward and equally spaced from corner 24. A curved ledge 30 projects inward from the convex surface of each column 28. The corner support 26 includes a pair of legs 32 extending downward at an angle onto the ledges 30. The lower end of each leg 32 is concave, so as to mate with the convex inner surface of the column 28 and rest on the curved ledge 30. Of course, it is contemplated that the lower end of each leg may be straight or have other configurations without departing from the teachings herein. The mating communication between the legs and the columns allow the load from above stacked containers to be transferred from the supports 26 through the walls 14, 20 of container 10.

The corner support 26 further includes a reinforcing rib 33 extending perpendicularly between the legs 32. As can be seen in FIG. 2, the corner support 26 generally includes a roughly triangular upper surface 34 across which reinforcing ribs 35 extend diagonally across upper edges of side wall 14 and end wall 20. Corner support 26 further includes a stacking projection 36 extending upward from the upper surface 24 of the corner support 26. The stacking projection 36 includes a semi-cylindrical upper surface between tapered axial ends 37 and has an axis oriented 45 degrees relative to both the side wall 14 and end wall 20. A living hinge 50 connects one side of the corner support 26 to an upper edge of the end wall 20 (best shown in FIGS. 2 and 3.)

Figure 3:
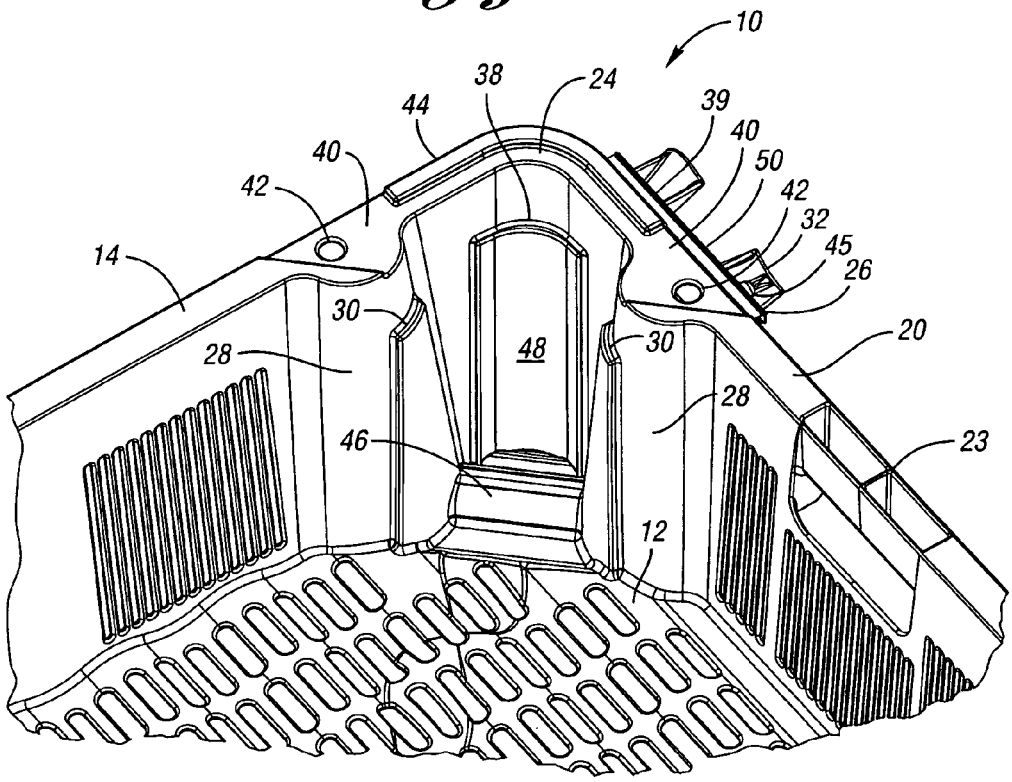
FIG. 3 is the corner of the container of FIG. 2, with the corner support in the open position.

FIG. 3 illustrates the interior corner 24 of the container 10 of FIG. 2, but with the corner support 26 in the open position, having been hingeably pivoted outward about the hinge 50. As can be seen in FIG. 3, the concave inner surface of the corner 24 includes a curved ledge 38 for supporting a third leg 39 on corner support 26 (best shown in FIG. 4). The third leg 39 is curved such that a lower edge mates with the ledge 38.

An upper surface 40 of each column 28 includes an aperture 42 for receiving posts 45 on the corner support 26. A ridge 44 is formed on an outer periphery of an upper surface of the corner 24. A protrusion 46 connecting the two columns 28 in the corner 24 extends upward from the base 12 in order to form a pocket 70 on the underside of container 10 for receiving a stacking protrusion 36 of the corner support on a below container. The protrusion 46 connecting the two columns 28, together with the two columns 28 and the inner concave surface of corner 24 define a corner cavity 48.

Figure 4:
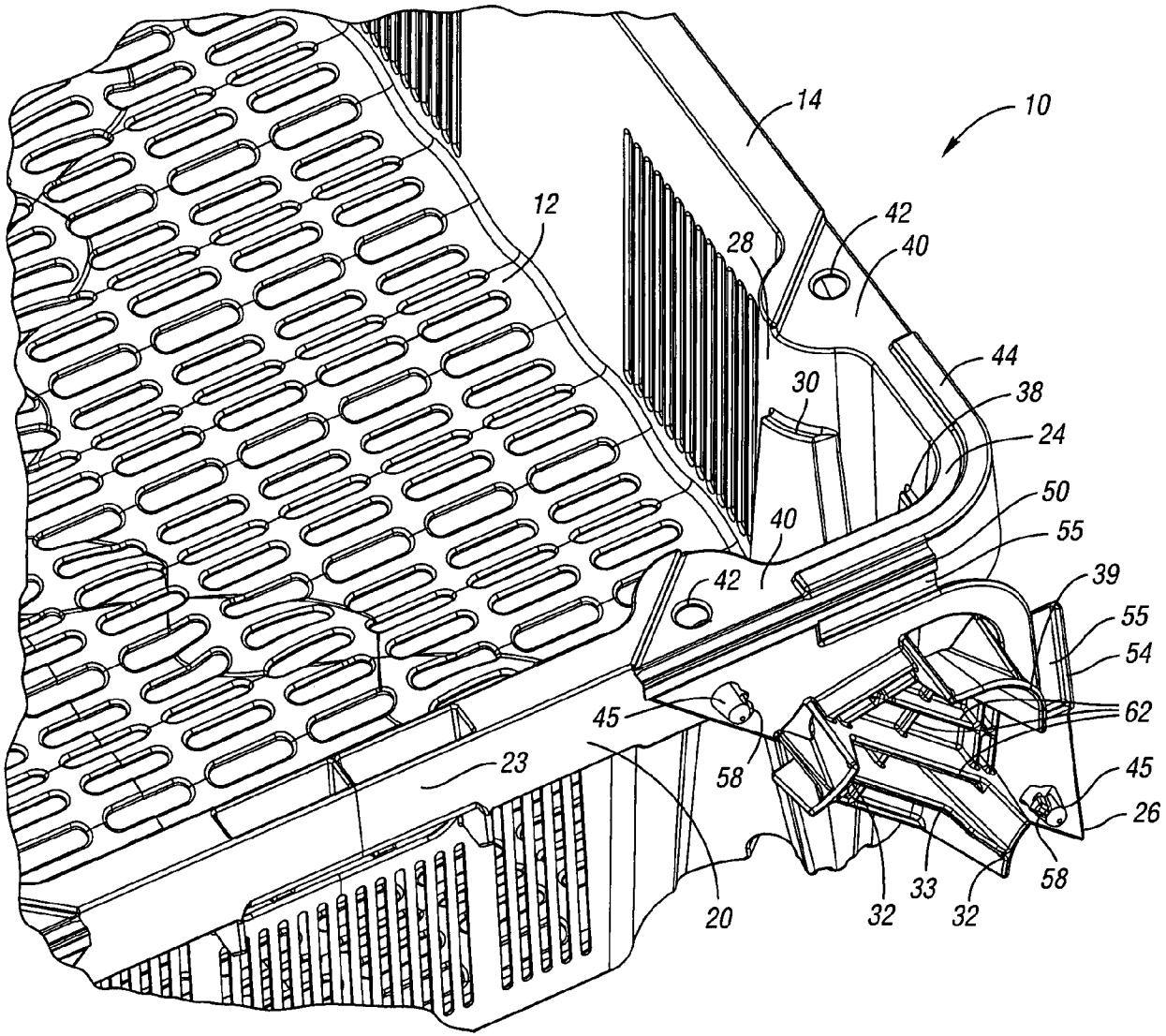
FIG. 4 is an exterior perspective view of the corner and corner support of FIG. 3 with the corner support in the open position.

FIG. 4 is an exterior view of the corner 24 of the container 10 of FIG. 3, with the support 26 in the open position. As can be seen in FIG. 4, in the open position, the corner support 26 hangs downward adjacent the end wall 20 from the living hinge 50 connected to the upper edge of the end wall 20. The corner support 26 includes a tab 54 projecting downward for locking over the ridge 44 on the upper surface of the corner 24 when the corner support 26 is in the support position to increase the strength of the support and prevent the side wall 14 and the corner support 26 from collapsing inwardly. Recessed area 55 adjacent tab 54 receives a portion of ridge 44 when in the closed position. As can be seen in FIG. 4, the third leg 39 of the corner support 26 includes a convex curved lower edge for engaging the ledge 38 on the inner surface of the corner 24. The two legs 32 have concave curved lower edges that mate with the ledges 30 formed on the concave surfaces of pillars 28. The corner support 26 includes two posts 45 with snap fit tabs 58 for locking the posts 45 into the apertures 42 on the upper surface 40 of each column 28. A plurality of ribs 62, including rib 33 are formed on the underside of the corner support 26, to increase the strength and rigidity of the corner support 26 and the legs 32, 39.

Figure 5:
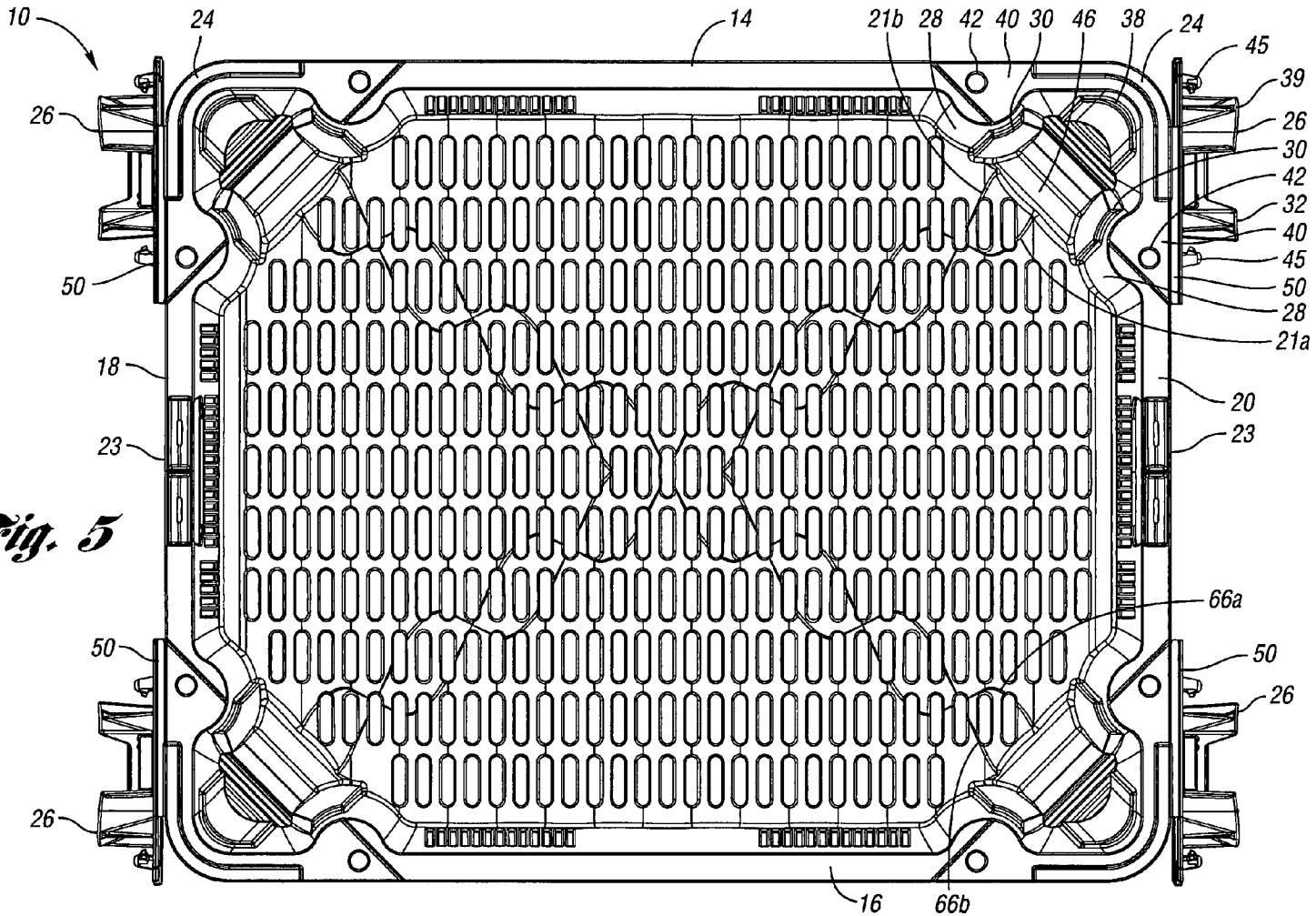
FIG. 5 is a top view of the container of FIG. 1, with all of the corner supports in the open position.

FIG. 5 is a top view of the container 10 with all four of the corner supports 26 pivoted about their respective hinges to the open position, where each corner support 26 rests adjacent its respective end wall 18, 20. As can be seen in FIG. 5, the roughly sinusoidal, out-of-phase, channel depressions 21*a* and 21*b* extend diagonally from one corner 24 to a diagonally opposite corner 24. Similarly, a second set of roughly sinusoidal, out-of-phase channel depressions 66*a* and 66*b* are also superimposed on the otherwise sinusoidal surface of the base 12, extending between opposite corners 24, generally perpendicularly to the first set of channel depressions 21*a*, 21*b*. With the corner supports 26 in the open position, a like container can be nested within the walls 14, 16, 18, 20 to reduce the space necessary for storage. As can be seen in FIG. 5, the corner supports 26 hang down alongside end walls 18 or 20.

Figure 6:
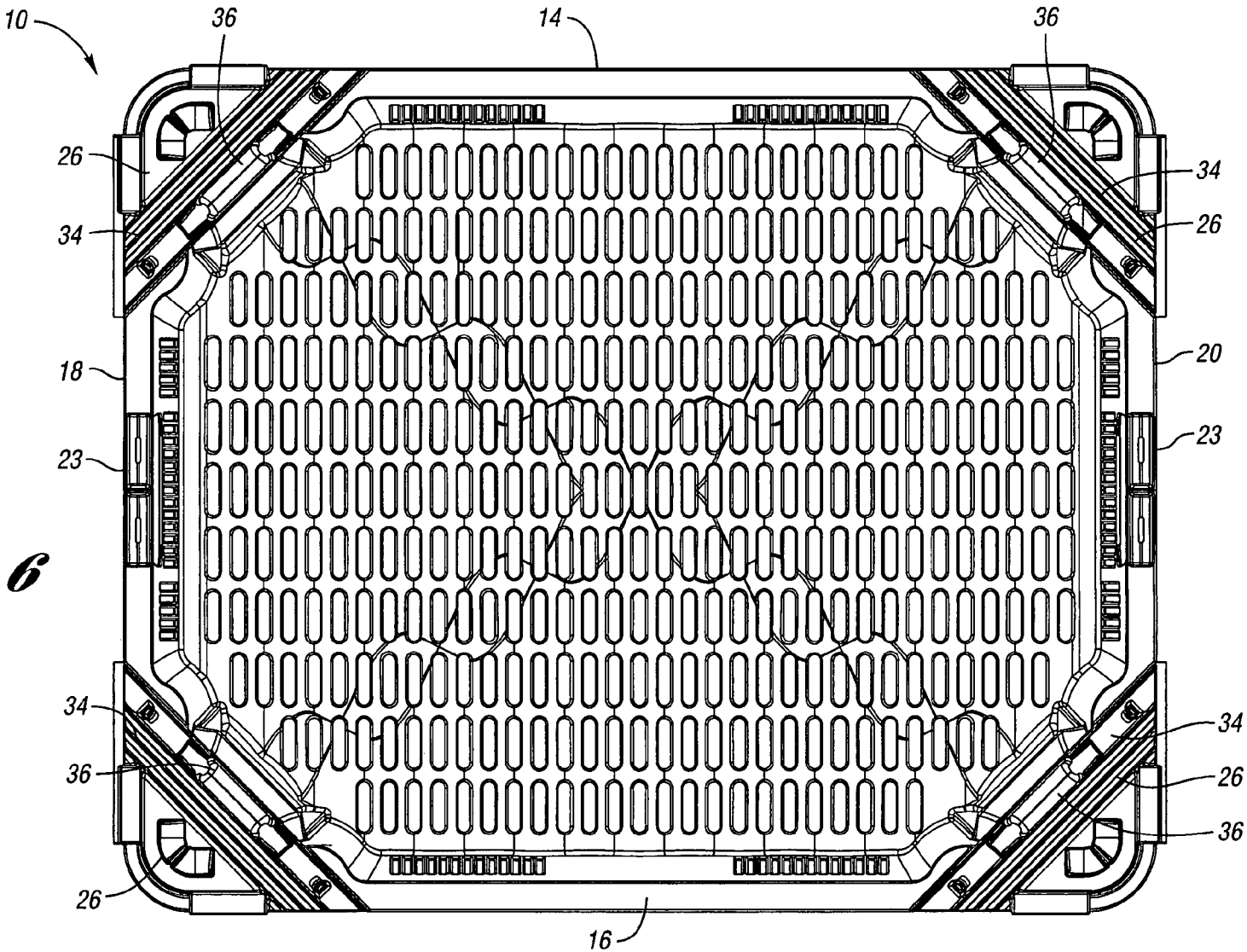
FIG. 6 is a top view of the container, similar to FIG. 5, with all of the corner supports in the support position.
Figure 7:
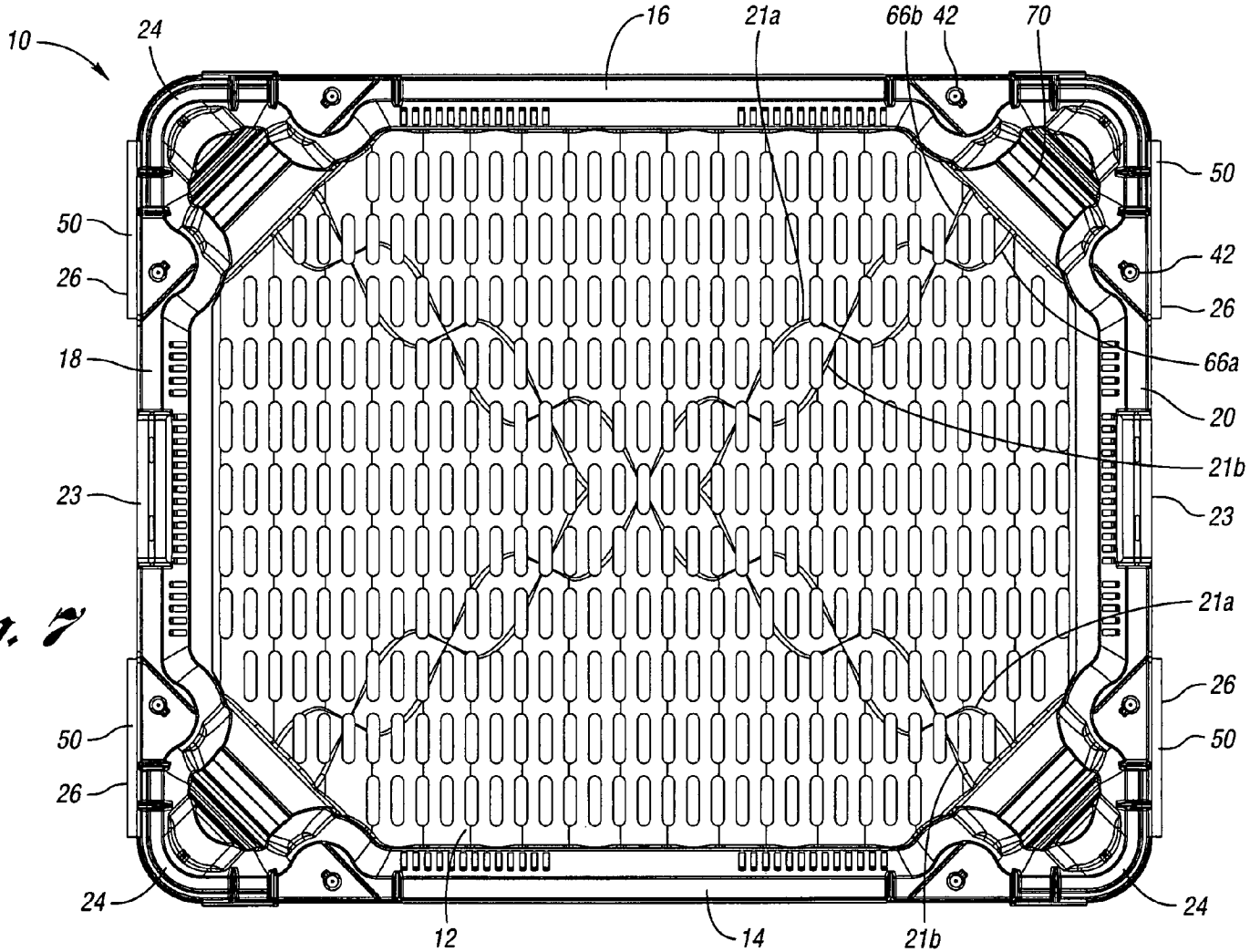
FIG. 7 is a bottom view of the container of FIG. 1.

When in use, the corner supports 26 are flipped up to the use position as shown in FIG. 6, where a like container can be stacked on the upper surfaces 34 of the corner supports 26. As can be seen in FIG. 6, the axes of the stacking projections 36 in opposing corners 24 are generally parallel to one another, while the stacking projections 36 in adjacent corners are generally perpendicular to one another. Further, each stacking projection 36 is received within a corresponding pocket 70 (FIG. 7) in the underside of the container 10. FIG. 7 is a bottom view of the container of the present invention.

Figure 8:
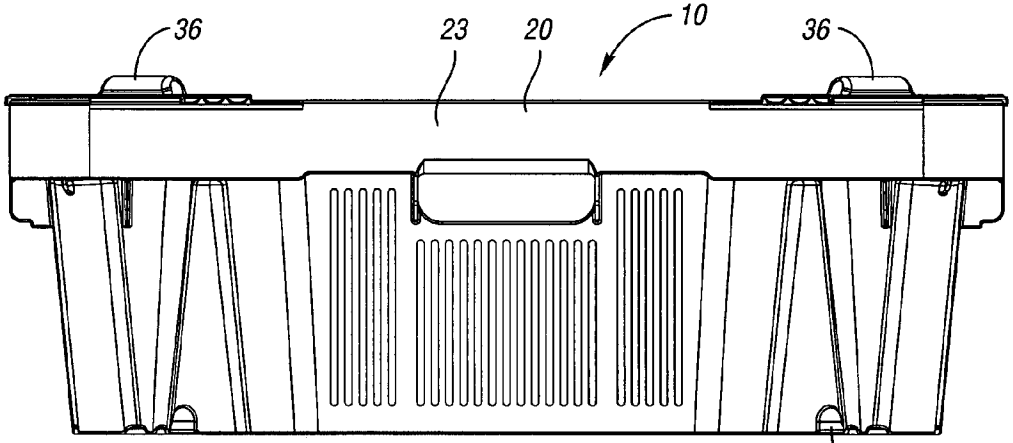
FIG. 8 is an end view of the container of FIG. 1.
Figure 9:
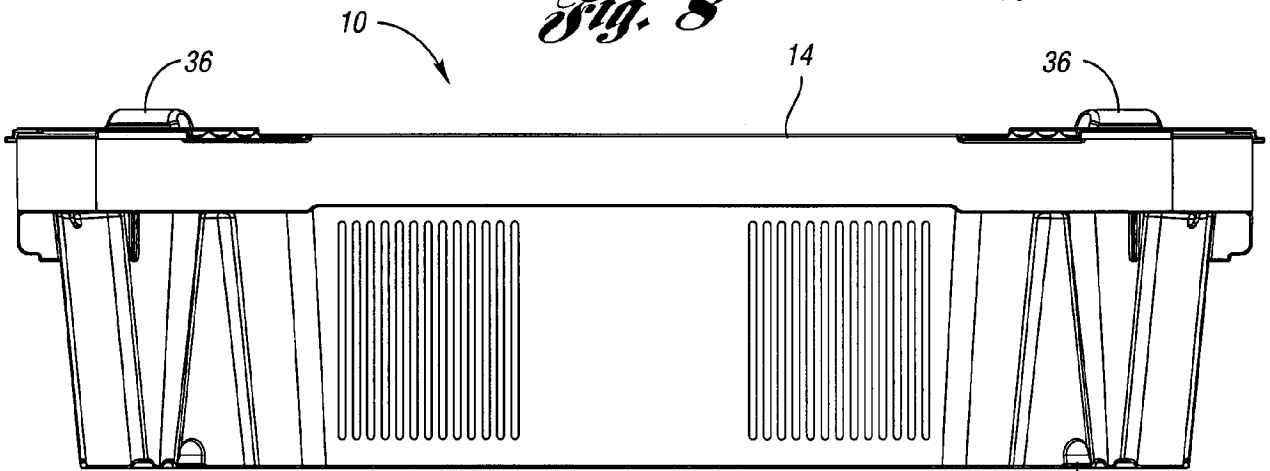
FIG. 9 is a side view of the container of FIG. 1.

FIG. 8 is an end view of the container 10 of the present invention. FIG. 9 is a side view of the container 10 of the present invention. The container 10 is preferably formed of polypropylene via an injection molding process, but can be formed of any type of plastic applicable for the desired use.

Figure 10:
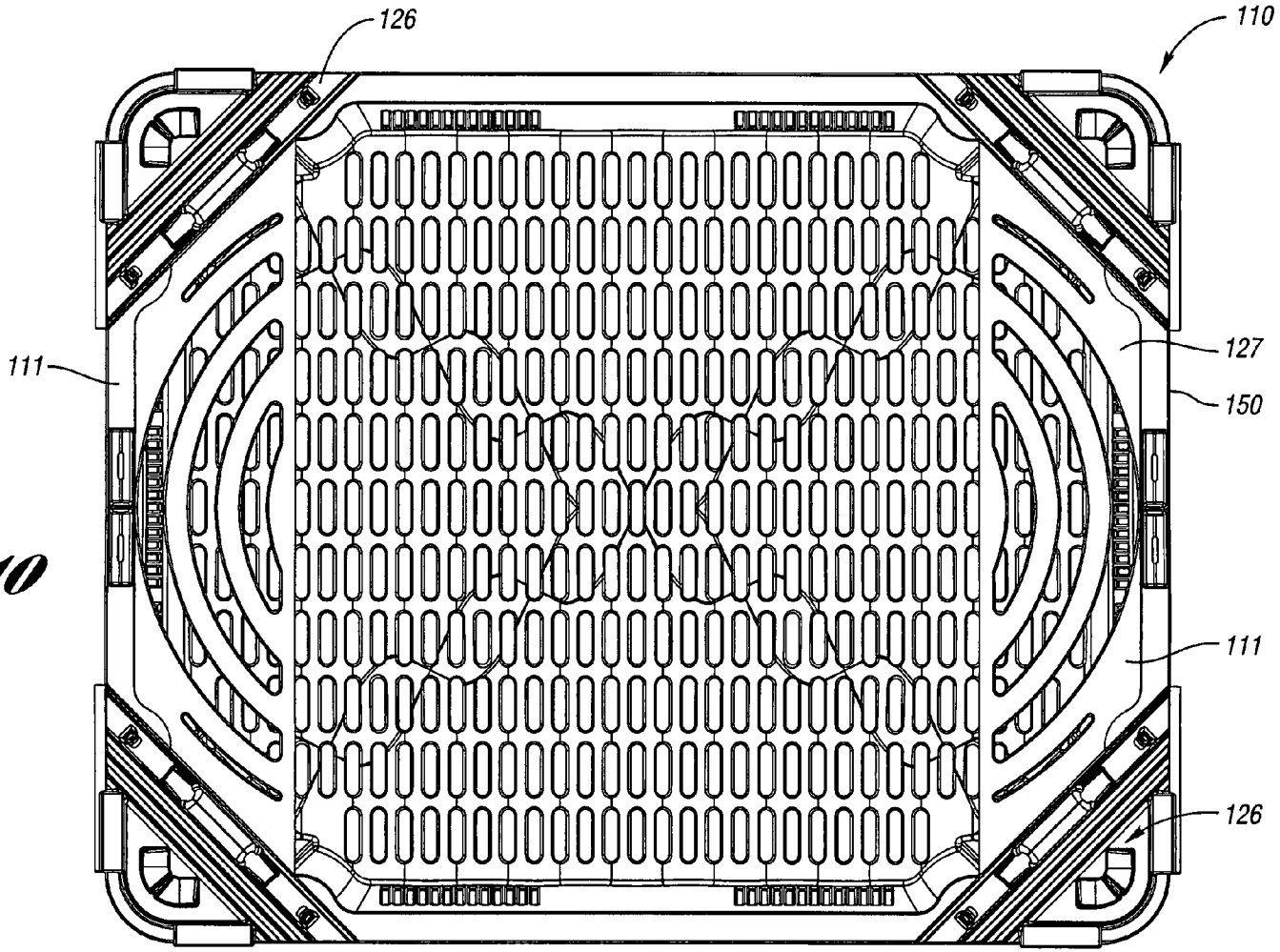
FIG. 10 is a top view of a second embodiment of a container according to the present invention, showing the lid members in the closed position.
Figure 11:
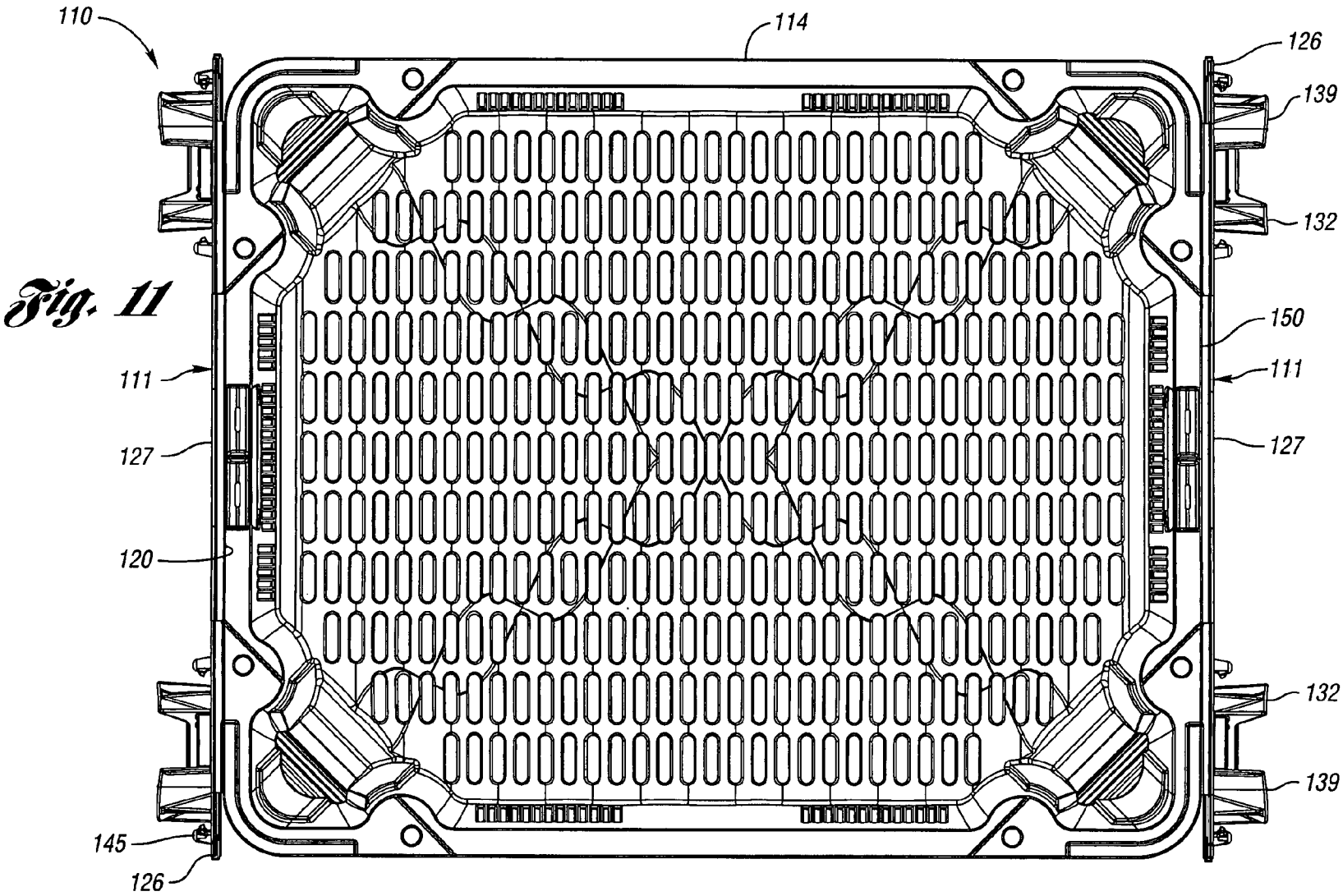
FIG. 11 is top view of the container of FIG. 11, showing the lid members in the open position.

FIGS. 10–11 illustrate a second embodiment of a container 110 according to the present invention. Container 110 is similar to container 10, and similar components have similar reference numbers assigned thereto, with the addition of a "1" prefix. However, container 110 includes two opposed lid sections 111 extending across the side walls 114. FIG. 10 shows the lid sections 111 in the closed position, and FIG. 11 shows the lid sections 111 in the open position, in which the lid sections 111 are folded back by way of a living hinge 150 disposed across end wall 120, or a portion thereof. As noted in FIG. 11, each lid section 111 integrally includes a corner support 126 at each end (similar to corner support 26), and also includes a central portion 127 connecting corner support portions 126. Support portions include legs 132, 139 and posts 145 as heretofore described in association with the first embodiment. This provides for a greater surface area upon which a crate 10, 110 stacked above may rest, while maintaining the improved load transfer properties of the first embodiment. Of course, in this embodiment, other load transfer mechanisms such as legs and columns may also be incorporated along the end wall 120 and the central portion 127 of lid section 111.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A storage container comprising:

a base;

a plurality of walls extending transversely from the base, each adjacent pair of the walls extending transversely to one another and meeting in one of a plurality of corners, the plurality of walls including a first wall and an adjacent second wall meeting in a first corner, and a support connected via a hinge to the first wall and moveable about the hinge between an open position and a support position generally parallel to the base where it is supported by the first wall and a second portion of the support is supported by the second wall, the support not contacting or supported by any of the plurality of walls other than the first wall and the second wall when the support is in the support position, and the support including an outer peripheral edge having a cutout between the first portion and the second portion such that the support does not contact a portion of the corner when the support is in the support position.

2. A storage container according to claim 1 wherein the plurality of walls and the base at least partially define an interior of the container, and wherein the support is moveable about the hinge from the support position generally in the interior of the container to the open position out of the interior of the container.

3. A storage container according to claim 1 further including a plurality of supports like the support, each support connected via a hinge to one wall of the plurality of walls and supported by the one wall and an adjacent wall when in the support position and not by any walls other than the one wall and the adjacent wall.

4. A storage container according to claim 1 further including a ledge on an inner face of at least one of the first or second walls, the support including at least one leg extending downward onto the ledge.

5. A storage container according to claim 1 further including a ledge protruding inwardly from each of an inner face of the corner and an inner face of each of the first and second walls, the support including a leg extending downwardly onto each ledge when the support is in the support position.

6. A storage container according to claim 1 wherein the support includes an innermost face extending transversely to both of the two walls from one of the first and second walls to the other.

7. A storage container according to claim 1 wherein the support includes an outer end away from the hinge supported by second wall when the support is in the support position, at least one of the outer end and an upper surface of the second wall including a post engaging the other of the outer end of the support and the upper surface of the second wall when the support is in the support position.

8. A storage container according to claim 7 wherein the outer end of the support includes the post, the post snap-fit into a hole in the upper surface of the second wall.

9. A storage container according to claim 8 wherein an inner end of the support includes a locking post in snap-fit engagement with an upper surface of the first wall.

10. A storage container according to claim 1 wherein the support includes a generally triangular upper surface.

11. A storage container according to claim 1 wherein the support includes an elongated first locator complementary to an elongated second locator on an underside of the base, such that the first locator would engage the second locator of a like container stacked on the support, the first and second locators extending transversely to both the first wall and the second wall.

12. A storage container according to claim 1 wherein the hinge is a living hinge.

13. A storage container according to claim 1 wherein the support is supported by an upper surface of each of the first and second walls when in the support position.

14. A storage container according to claim 1 further including a handle on the first wall, the support supported by an upper surface of the first wall only upon a portion of the upper surface of the first wall that is entirely between the handle and the corner.

15. A storage container according to claim 1 wherein the plurality of walls comprises four walls and wherein the support is one of a plurality of supports each in one of the corners, each support pivotably connected to one of the four walls and each supported only by two of the four walls.

16. A storage container comprising:

a base;

four walls extending upward from the base a first wall and an adjacent second wall extending transversely from the base and transverse to one another, the first and second walls meeting at a corner, at least one of the first wall, the second wall and the corner including a ledge on an inner face; and a support supported by the two walls, and hingeably connected to at least one of the two the support generally parallel to the base, the support including at least one leg extending downward to a lower end resting on the ledge, the at least one leg extending from the lower end up to an upper end spaced inwardly from an interior surface of its respective one of the first wall, the second wall and the corner.

17. A storage container according to claim 16 wherein the at least one leg includes a first leg and a second leg, and wherein the ledge is a first ledge on the inner face of the first wall, and the container further including a second ledge on an inner face of the second wall, the first leg extending downward to the first ledge, the second leg extending downward to the second ledge.

18. A storage container according to claim 17 further including a third ledge on an inner face of the corner, the support further including a third leg extending downward to the third ledge.

19. A storage container according to claim 18 wherein each of the first, second and third legs are distinct from one another.

20. A storage container according to claim 19 wherein the support is connected via a hinge to one of the first and second walls.

21. A storage container comprising:

a base;

two adjacent walls extending transversely from the base and transverse to one another and meeting in a corner, each of the two walls including an inwardly protruding column spaced away from the corner, at least one column including a ledge formed on an interior surface thereof, the interior surface spaced inwardly from the associated wall and extending upwardly from the ledge; and a support hingeably connected to at least one of the two walls and supported by an upper surface of each column, the support including an innermost edge extending transversely to both of the two walls, the support including at least one leg extending downwardly from the support to the at least one ledge.

22. A storage container according to claim 21 wherein the support is supported by an upper surface of the corner.

23. A storage container according to claim 21 wherein the support is connected via a hinge to a first wall of the two walls and moveable about the hinge between a support position where it is supported by the two walls generally parallel to the base and an open position generally transverse to the base.

24. A storage container according to claim 23 further including a ledge defined on an inner face of each column, the support including at least one leg extending to the ledges.

25. A storage container according to claim 24 further including a corner ledge defined on an inner face of the corner, the corner ledge supporting the support.

26. A storage container according to claim 25 wherein the support further includes a corner leg extending downwardly to the corner ledge.

27. A storage container according to claim 24 wherein the at least one leg includes at least two legs, each extending to one of the two ledges on the inner surfaces of the walls.

28. A storage container according to claim 24 wherein the ledges are convex inwardly of the container and wherein the at least one leg has a complementary concave lower surface for engaging the ledges.

29. A storage container according to claim 28 wherein the support further includes a corner ledge defined on an inner face of the corner, the corner ledge extending around the corner, a complementary corner leg extending downwardly to the corner ledge from the support.

30. A storage container comprising:

a base;

four walls extending transversely from the base, each adjacent pair of the walls extending transversely to one another and meeting in one of a plurality of corners; and a support adjacent each of the corners, each of the supports hingeably connected to the walls and pivotable between a support position substantially parallel to the base and an open position transverse to the base, each of at least two of the supports including an elongated first locator protruding upwardly from the at least two supports, each first locator complementary to an elongated recessed second locator on a corresponding position on an underside of the base, such that each first locator would engage the corresponding second locator of a like container stacked on the support surfaces, the first and second locators extending transversely to the four walls.

31. A storage container according to claim 30 wherein each of the first locators comprises a semi-cylindrical projection having an axis that is transverse to the four walls.

32. A storage container according to claim 31 wherein the at least two of the supports comprises four support surfaces, one adjacent each corner, each corner of the container having associated therewith an opposite corner of the plurality of corners and two adjacent corners of the plurality of corners, wherein each first locator has an axis that extends substantially parallel to the first locator in the opposite corner, and wherein the axis of each first locator extends substantially perpendicularly to the axes of the first locators in the two adjacent corners.

33. A storage container comprising:

a base;

a plurality of walls extending upwardly from the base, each adjacent pair of the walls meeting in one of a plurality of corners, each corner having a horizontally concave inner face, the plurality of walls including a first wall and an adjacent second wall meeting in a first corner, the first corner including a first support surface formed on the horizontally concave inner face; and a support connected via a hinge to the first wall and moveable about the hinge between an open position and a support position where it is supported by the first wall and the second wall, the support including an upper support surface generally parallel to the base, the support not contacting or supported by any of the plurality of walls other than the first wall and the second wall, the support including a leg extending downwardly to the first support surface, the first support surface supporting the support via the first leg.

34. The storage container of claim 33 wherein the inner faces of the corners are curved and wherein the leg is curved in a complementary manner to the inner face of the corner.

35. The storage container of claim 16 wherein the at least one leg extends inwardly and upwardly from the lower end to the upper end, the upper end positioned directly above the base.

36. The storage container of claim 16 wherein the inner face of the first wall includes the ledge and the inner face of the second wall includes the ledge, the at least one leg including a first leg extending inwardly and upwardly from the ledge on the inner face of the first wall and a second leg extending inwardly and upwardly from the ledge on the inner face of the second wall, the upper end of the first leg being spaced inwardly away from the first wall, the upper end of the second leg being spaced inwardly away from the second wall.

* * * * *

UNITED STATES PATENT AND TRADEMARK OFFICE

CERTIFICATE OF CORRECTION

PATENT NO. : 6,994,216 B2
APPLICATION NO. : 10/410565
DATED : February 7, 2006
INVENTOR(S) : Wong It is certified that error appears in the above-identified patent and that said Letters Patent is hereby corrected as shown below:

IN THE CLAIMS:

Column 4, Line 49, please delete “it” and insert --a first portion of the support--.
Column 5, Line 19, please insert --the-- before “second wall”.
Column 5, Line 57, please insert --including-- after “upward from the base”.
Column 5, Line 64, please insert --walls-- after “at least one of the two”.

Signed and Sealed this

Fourteenth Day of October, 2008

JON W. DUDAS
*Director of the United States Patent and Trademark Office*